US006085383A

United States Patent [19]

Wulff et al.

[11] Patent Number: 6,085,383

[45] Date of Patent: Jul. 11, 2000

[54] VACUUM CLEANER BRUSH WRAP GEOMETRY

[75] Inventors: Richard F. Wulff, Maple Plain; Nilabh Narayan, Plymouth, both of Minn.; Daniel G. Giddings, Holland, Mich.; Dick Mason, Buffalo, Minn.

[73] Assignee: Castex Incorporated, Holland, Mich.

[21] Appl. No.: 09/166,516

[22] Filed: Oct. 5, 1998

[51] Int. Cl.[7] ..... A47L 5/30

[52] U.S. Cl. ..... 15/383; 15/366; 15/372

[58] Field of Search ..... 15/366, 372, 383

[56] References Cited

U.S. PATENT DOCUMENTS

| | | | |
|---|---|---|---|
| 1,587,794 | 6/1926 | O'Brien | 15/363 X |
| 1,957,506 | 5/1934 | Smellie | 15/366 |
| 2,310,267 | 2/1943 | Taylor | 15/366 X |
| 4,178,653 | 12/1979 | Tschudy | 15/383 |
| 5,020,186 | 6/1991 | Lessig et al. | 15/366 X |
| 5,784,756 | 7/1998 | Slocum et al. | 15/383 X |

*Primary Examiner*—Chris K. Moore

*Attorney, Agent, or Firm*—Price, Heneveld, Cooper, DeWitt & Litton

[57] ABSTRACT

A vacuum cleaner comprising a housing having an elongated transverse brush cavity with an elongated cylindrical brush therein, a duct having an air flow nozzle adjacent the brush cavity for receiving dirt-entrained air from the brush cavity, a vacuum motor operably associated with the duct and nozzle to draw dirt-entrained air through the nozzle and duct, and the brush cavity having a wrap configuration geometry over the brush including an elongated reflective ledge angled laterally upwardly toward the nozzle.

18 Claims, 6 Drawing Sheets

VACUUM CLEANER BRUSH WRAP GEOMETRY

BACKGROUND OF THE INVENTION

This invention relates to upright floor vacuum cleaners. Upright carpet vacuum cleaners typically employ a rotating cylindrical brush to loosen dirt particles from carpet fibers and allow the dirt to move into the air flow stream for entrainment of dirt into an air duct and ultimately to a dirt receptacle, and to lift the carpet pile for appearance and longer life and to assist the flow of air.

It is known that such cleaners have difficulty picking up grains of sand, and also larger debris such as ice melt, salt pellets and pea rocks, all of which are often found in commercial buildings, especially during the winter. Grains of sand tend to bounce erratically off the cleaner brush, to remain behind the moving cleaner. Consequently the vacuum cleaner must be operated back and forth many times in the same area in efforts to gather such materials off the floor. Prior art upright carpet cleaners of the assignee herein included those having a cylindrical brush with helical bristles oriented in opposite helical directions from the brush ends, a suction nozzle, and an elongated structural portion generally normal to the brush, extending along the brush at a substantial fraction of an inch from the brush.

SUMMARY OF THE INVENTION

The present invention was conceived and developed to greatly improve efficiency of cleaning of a floor surface, whether carpet or hard surface, not only of smaller dirt particles, but also of sand particles and larger debris such as ice melt, salt pellets and pea rocks. The vacuum cleaner housing defines a bottom, transverse brush cavity having an upper periphery closely adjacent the rotationally mounted, generally cylindrical brush, and including a special downwardly oriented, reflection ledge closely adjacent the elongated rotating brush. This ledge is specially cooperative with helically arranged brush bristles to "auger" and bounce grains of sand and larger particles from the ends of the brush, axially along the brush, toward the suction nozzle. Larger debris such as ice melt, salt pellets and pea gravel, i.e., pea rocks, bounce successively off sequential portions of the sloped reflection ledge to ultimately reach the suction nozzle and hose for advancement to the dirt receptacle. The ledge is formed with a concavity along its length to result in air tunnel-type flow therealong, i.e., generally parallel to the brush axis, to assist advancement of debris and dirt to the suction nozzle. Typically the nozzle is located between the ends of the brush cavity, often more toward one end than the other. The reflection ledge is preferably sloped laterally upwardly from both opposite ends of the brush cavity to the nozzle location. The helical brush pattern is generated in opposite helical directions from opposite ends of the brush to the nozzle. Because the brush typically rotates to move peripherally down at the front and up at the rear, the reflection ledge is located at the rear of the brush cavity, very close to the radially outer ends of the brush bristles, i.e., about 0.030 inch from the brush bristles. The novel structure has been found to largely prevent debris particles from being carried around with the brush for potential redeposit on the floor, while advancing toward the nozzle. Testing has confirmed greatly increased efficiency of the floor cleaner using the novel features.

These and other features, advantages and objects of the present invention will be further understood and appreciated by those skilled in the art by reference to the following specification, claims and appended drawings.

DETAILED DESCRIPTION OF PREFERRED EMBODIMENT

Referring now specifically to the drawings, the novel cleaner 10 has three major components or subassemblies, namely base subassembly 12, filter bag subassembly 14, and handle subassembly 16.

Figure 10:
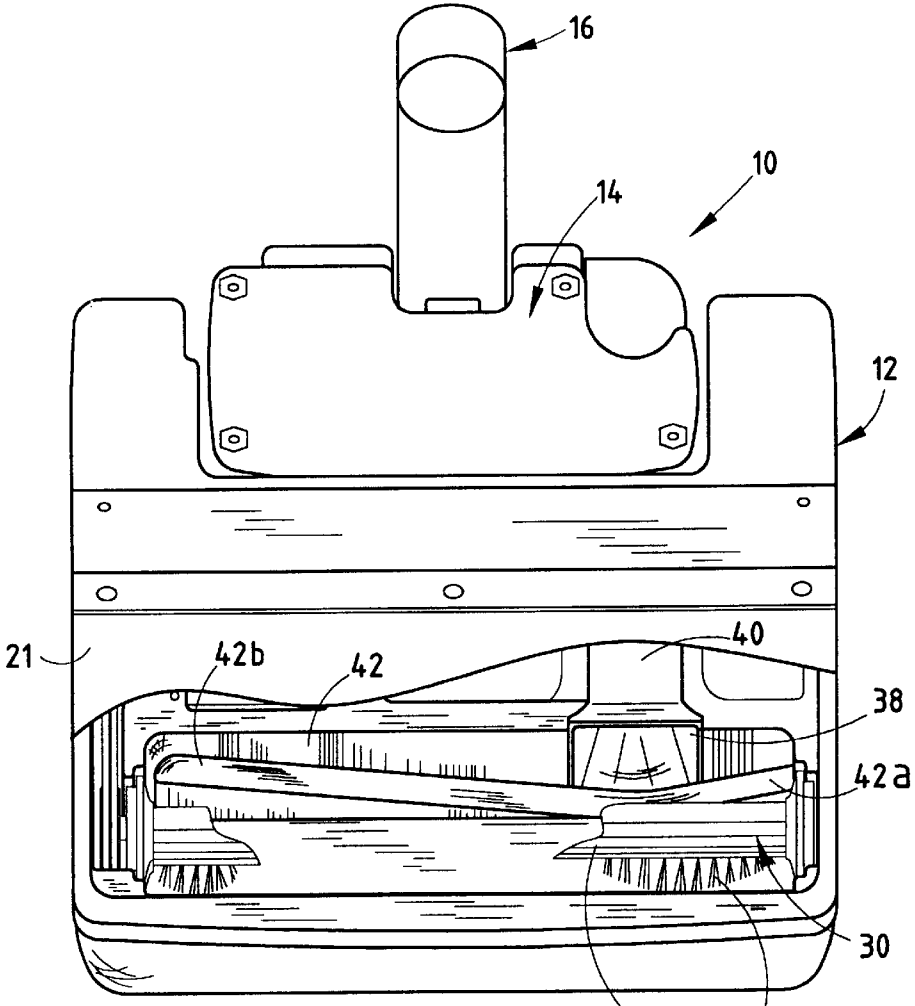
FIG. 10 is an enlarged schematic of the cleaner showing the underside cover panel cut away.
Figure 4:
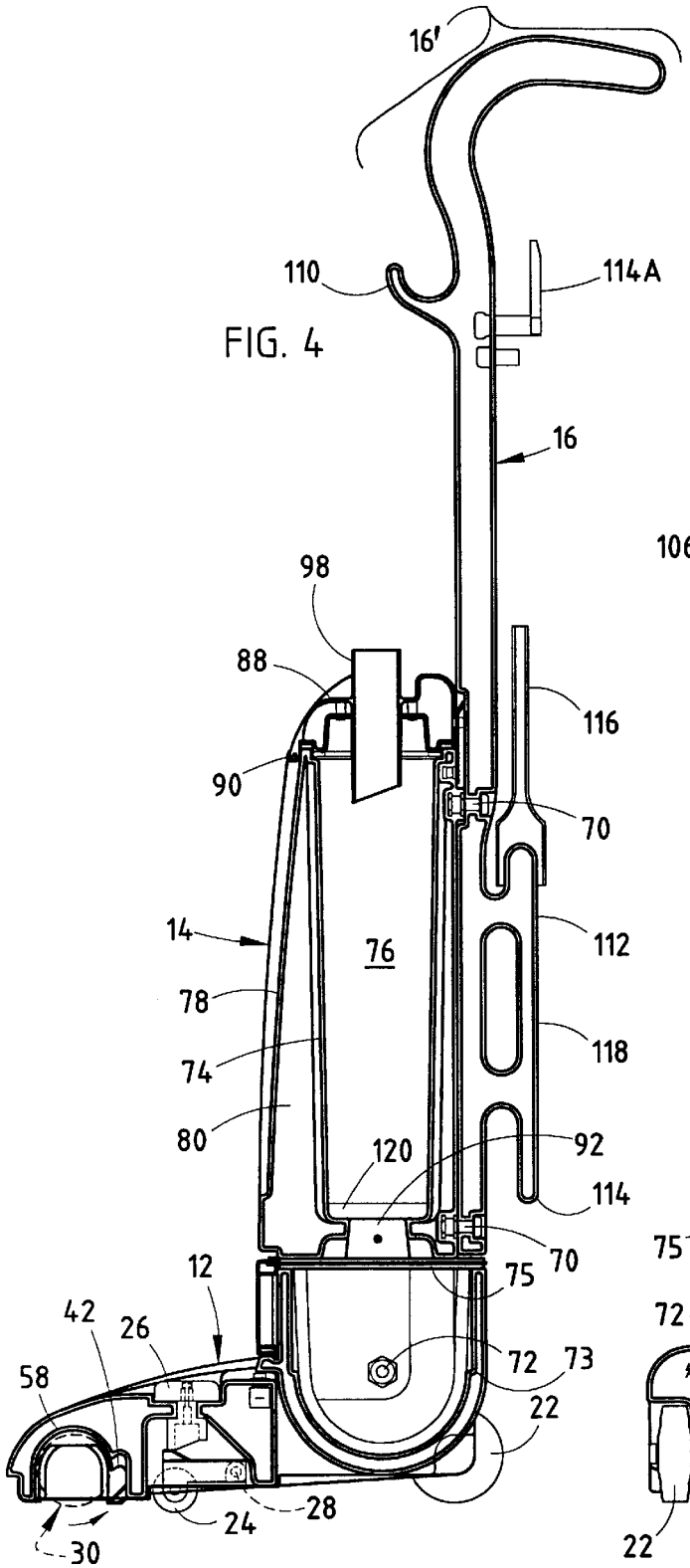
FIG. 4 is a side elevational sectional view of the cleaner.
Figure 8:
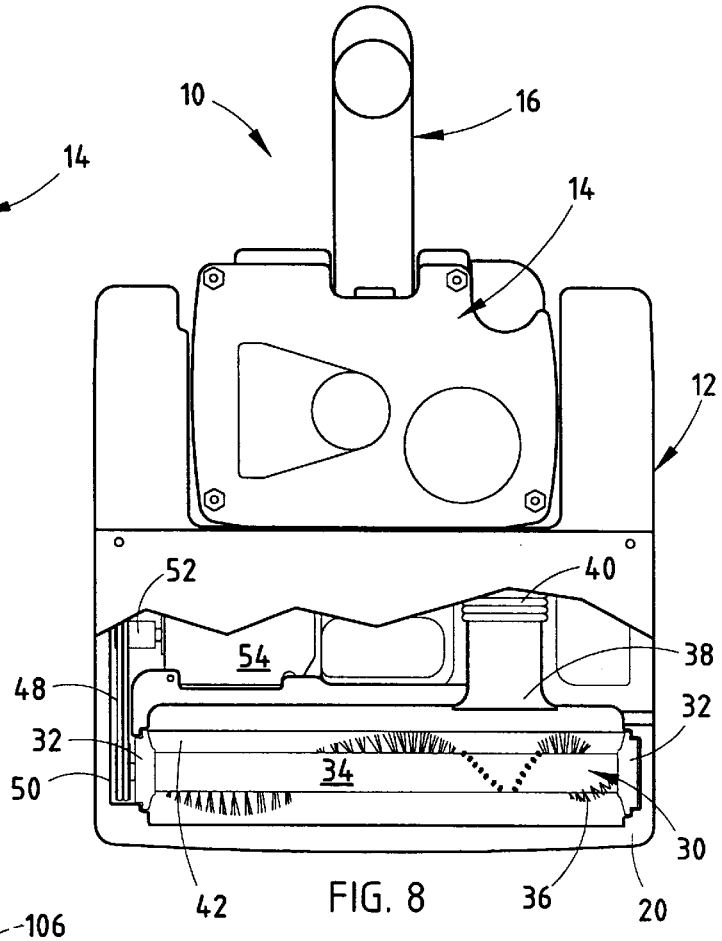
FIG. 8 is a bottom view of the cleaner.
Figure 9:
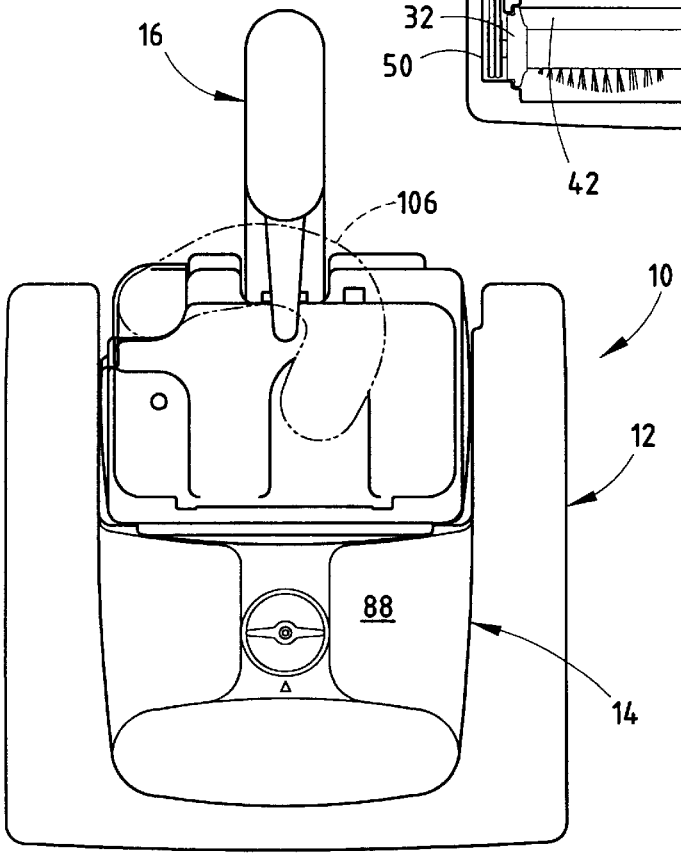
FIG. 9 is a top view of the cleaner.
Figure 12:
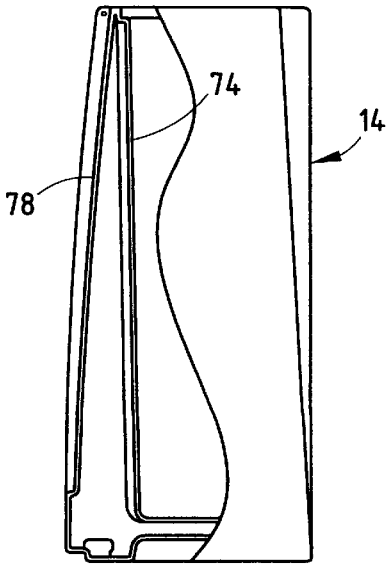
FIG. 12 is a side elevational view of the bag housing, partially cut away.

Base subassembly 12 comprises a base housing 20 which may be formed of various materials, but is preferably of roto-molded polymeric material. At the rear of this housing are rotationally mounted a pair of rear wheels 22. Midway between the rear and the front of the housing but offset more toward the front of the housing is a roller 24 (FIG. 4). Roller 24 is adjustable vertically by knob 26, to be moved vertically around pivot point 28 for controlling the degree of engagement of cleaning brush 30 with the floor surface to be cleaned. Cleaning brush 30 comprises an elongated cylindrical element extending across the front of the base (FIGS. 8 and 10) and mounted in end bearings 32. It has an elongated cylindrical hub 34 and radially projecting bristles 36 in a double helical pattern. The helical pattern of the bristles is in two opposite helical directions from the two opposite ends, the two patterns meeting at the area adjacent inlet nozzle 38 of duct 40. Typically the brush rotates in a direction such that the bristles move downwardly at the front of the brush and upwardly at the rear of the brush. These two portions of helical pattern brushes cooperate with a special reflector ledge 42 in a manner to be described hereinafter. Brush 30 is rotated by belts 48 on pulley 50 at the end of the brush, the belts being driven by pulley hub 52 on electric motor 54 retained within a motor receiving chamber of housing 20. Beneath motor 54 and some other portions of housing 20 is a removable underside cover panel 21. Brush 30 is exposed through an elongated opening in the panel.

Housing 20 defines a generally semi-cylindrical, elongated brush receiving cavity 58 (FIG. 4) that extends transversely of the housing and receives brush 30. It is open on the bottom to allow peripheral brush bristle engagement with the carpeted floor surface to be cleaned. Extending transversely across the housing at the rear of brush receiving cavity 58 is a special particle reflection and air tunnel ledge 42 (FIGS. 4, 8, and 10), which cooperates with brush 30 and suction nozzle 38. The particle reflection and air tunnel ledge has an upwardly concave, elongated configuration (see FIG. 4) that cooperates with the brush bristles to create air tunnel-like air flow along its length, i.e., generally parallel to the brush axis, toward nozzle 38. Nozzle 38 is located between the two ends of brush 30, typically offset more toward one end than the other. Two portions 42*a* and 42*b* of elongated reflection ledge 42 meet adjacent nozzle 38. Inverted reflector ledge 42, which is about 0.030 inch from the periphery of the brush bristles, preferably slopes upwardly from both ends thereof (FIG. 10) to an apex in front of nozzle 38. In the embodiment depicted, portion 42*a* of ledge 42 is considerably shorter than portion 42*b* extending from the opposite end, so as to meet in front of nozzle 38. The concave surface of inverted ledge 42 also slopes rearwardly upwardly from its forward apex as depicted in FIG. 4. Its position close to the brush bristles causes this reflector surface to be engaged by rising sand, pea gravel, ice melt, and salt pellet particles propelled by brush 30 as the brush rotates rearwardly during operation of the cleaner. These particles are reflected into the concave space to be advanced by the axial air flow along the reflection ledge. It has been found that the use of the special particle reflector and air tunnel ledge, in combination with the closely adjacent helical brush characteristics, causes even larger particles to progressively bounce off the reflective ledge, each bounce bringing the particles closer to nozzle 38 so that ultimately the particles are drawn through nozzle 38 and duct 40 toward a dirt retaining receptacle in bag housing 14.

Figure 1:
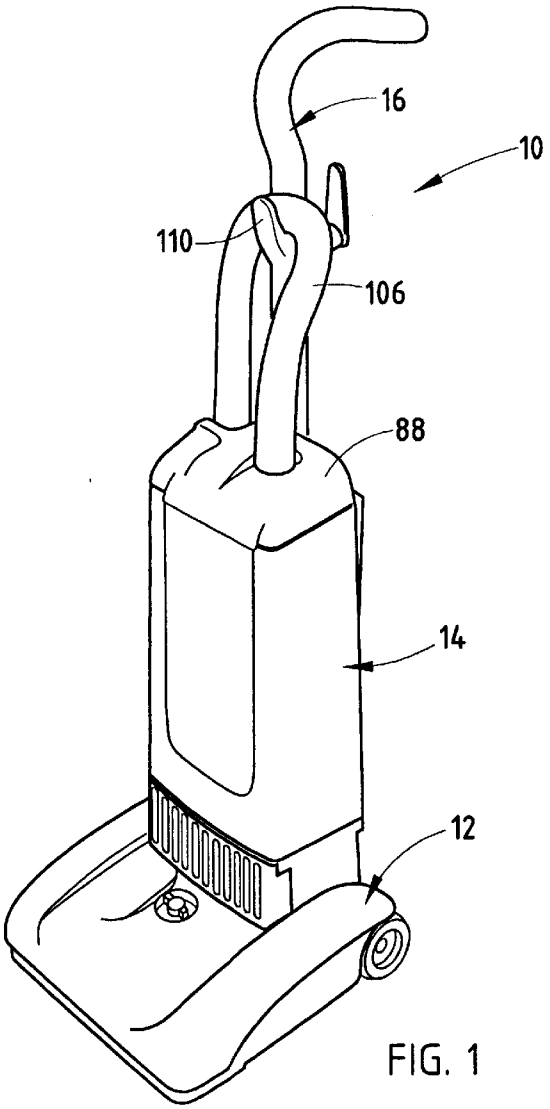
FIG. 1 is a perspective view of the novel cleaner.
Figure 2:
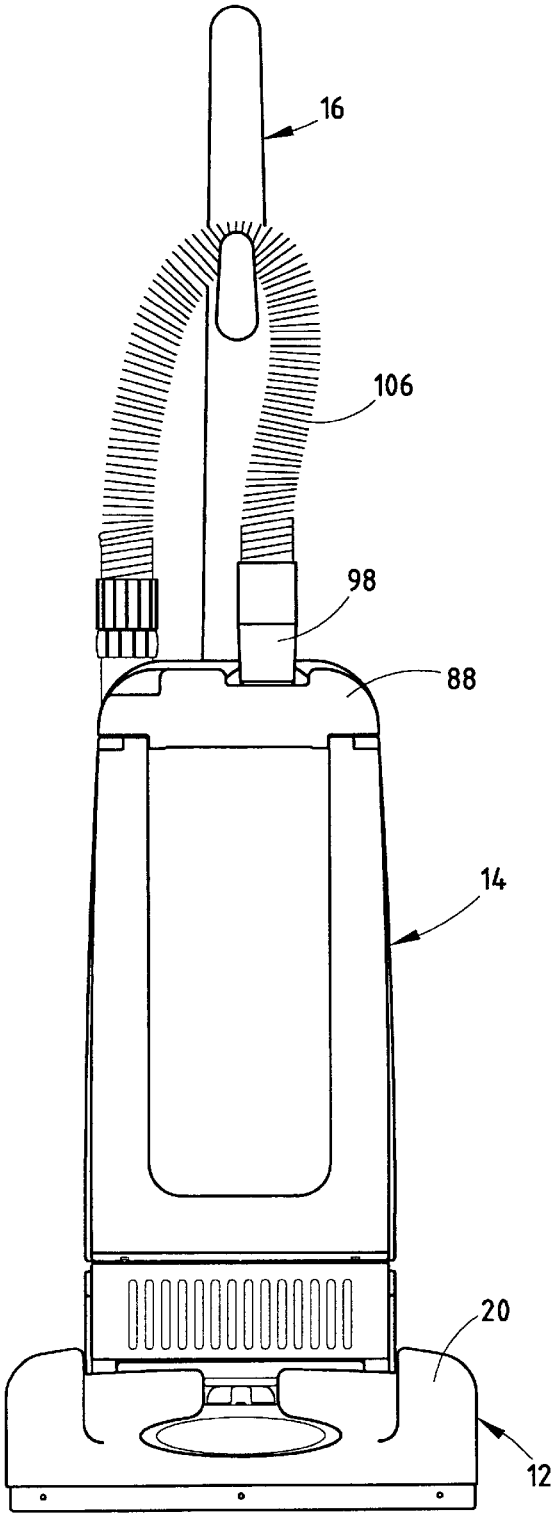
FIG. 2 is a front elevational view of the cleaner.
Figure 3:
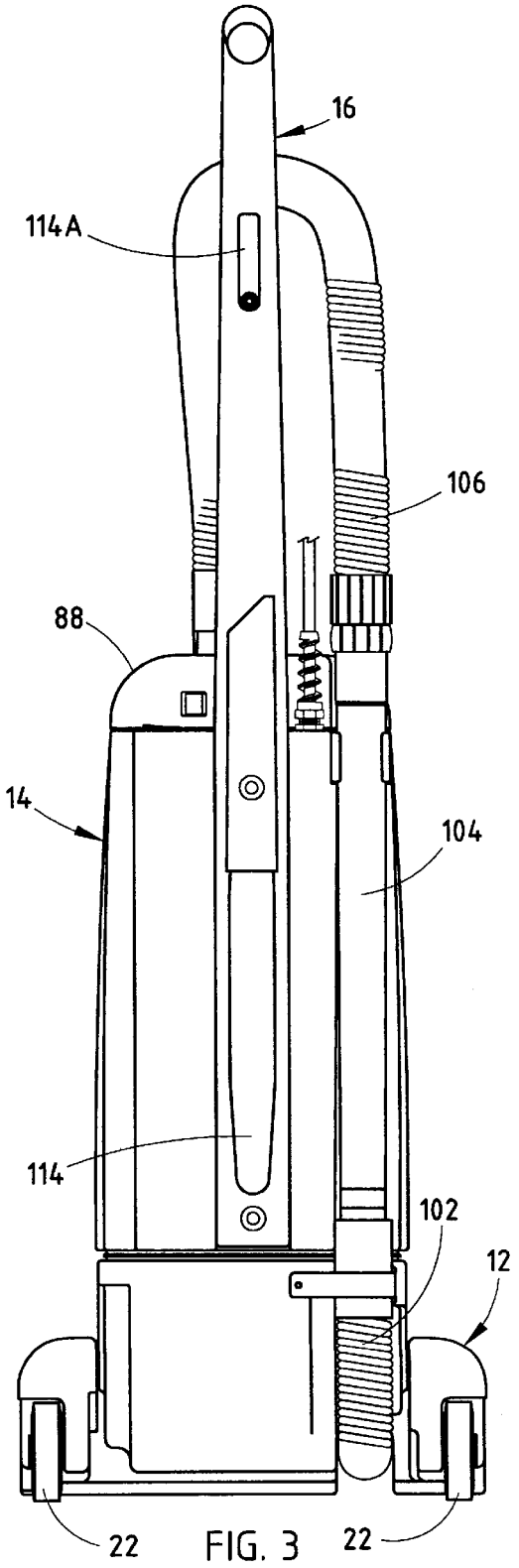
FIG. 3 is a rear elevational view of the cleaner.

Upright dirt retention housing 14, preferably formed of roto-molded polymeric material such as polyethylene, has handle subassembly 16 attached to it by fasteners 70 (FIG. 4). Housing 14 and handle 16 are pivotally attached at pivots 72 to base 12, to enable the housing and handle to be pivoted between an upright storage condition and a plurality of lowered upwardly-rearwardly sloping conditions, the most common of which is shown as the intermediate position in phantom lines in FIG. 6. If necessary, housing 14 and handle 16 can be lowered to the maximum amount depicted adjacent the floor surface in FIG. 6. Bag housing 14 (FIG. 4) has a peripherally enclosing inner wall 74 of significant thickness, defining a bag receiving chamber 76 therein. The housing also includes an outer wall 78 of significant thickness integrally joined at the top with inner wall 74 and spaced from the inner wall over its length, including at the bottom of the two walls, to define a space 80 therebetween. The outer surface of outer wall 78 is smooth as shown in FIG. 1, preferably having a front surface, a rear surface, and two side surfaces, all of which are generally planar. The inner wall 74 has an undulating characteristic, preferably generally sinusoidal along its two side walls, its front wall, and its back wall as depicted in FIG. 7. The comers are preferably diagonally positioned. These undulations define a plurality of vertically elongated recesses 84 and inwardly projecting, intermediate, vertically elongated protrusions 86. Placement of a dirt bag inside housing 14 is achieved by opening a pivotal cover 88 (FIG. 4) about frontal pivot point 90 to open the housing top for access to space 76. Recesses 84 provide excellent airflow passages adjacent the outer side walls of the dirt bag (not shown) placed in space 76. At the bottom of space 76 is the bag housing vacuum outlet 92 (FIG. 7), which communicates through a lateral passage 93 (FIG. 5) with vacuum motor and pump unit 94 (FIG. 5) to create a negative pressure, i.e., partial vacuum, around the bag exterior inside chamber 76. The porous dirt bag causes a lower negative pressure inside the bag. At the top of housing 14, extending through cover 88, is a tube 98 which serves as the inlet tube for dirt-laden air flow drawn from brush chamber 58 through nozzle 38, duct 40, hose 102 (FIG. 3), duct 104, and hose 106, to tube 98 and hence to chamber 76. It has also been determined that the undulation configuration of inner wall 74 allows easy removal of a filled dirt bag from chamber 76, because of minimal friction between wall 74 and the bag.

Figure 5:
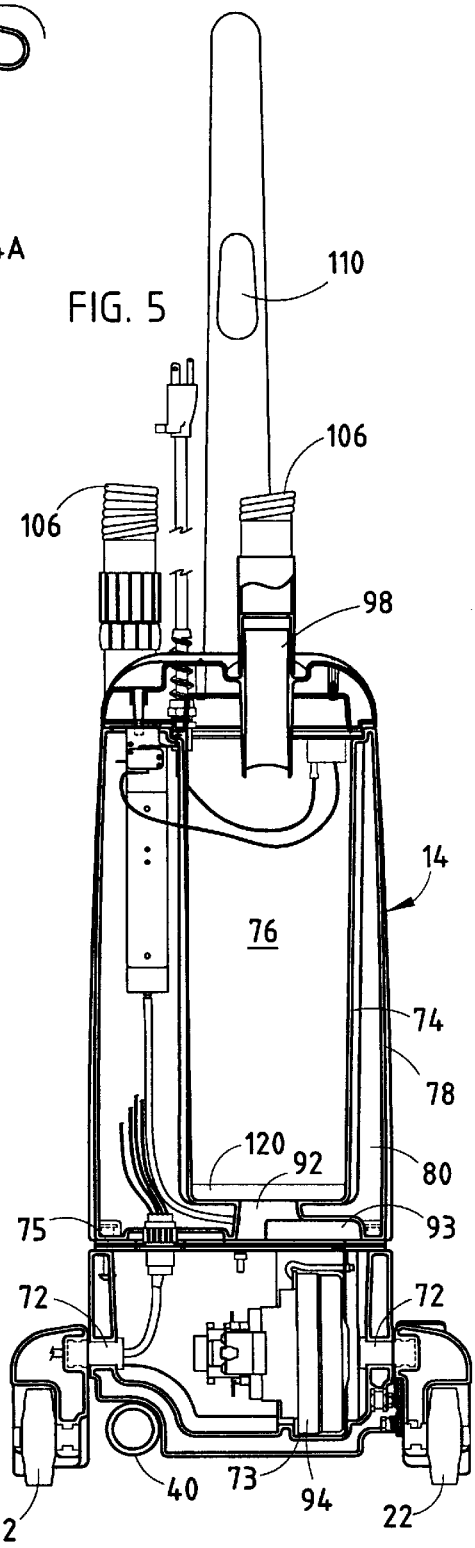
FIG. 5 is a front elevational sectional view of the cleaner.

Base assembly 12 has a chamber 73 which is specially configurated to receive and retain the vacuum motor and pump 94, as can be seen in FIGS. 4 and 5. Its bottom and side walls are curved to match the motor and pump so that no added fasteners need be used to retain them in position. The top is closed by a cover plate 75.

Handle 16 has a unique configuration and preferably is formed of molded polymer material. The handle extends upwardly above housing 14 when the cleaner is in the upright storage condition depicted in FIGS. 4 and 6. The handle extends upwardly above housing 14 in a vertical orientation, curves slightly forwardly near the top of the handle, then through an approximate 90 degree arc, and extends horizontally to the rear. The arcuate portion and horizontal extension constitute a hand grip zone 16'. The span of this arcuate portion is at least as large as the width of an adult human hand, i.e., about three inches or greater, to function effectively and comfortably. When the cleaner is lowered to the normal operating condition shown as the intermediate position in FIG. 6, handle 16 then extends diagonally upwardly-rearwardly, then slightly upwardly to blend into the 90° arcuate portion, and then extends diagonally downwardly rearwardly. This sloped downwardly-rearwardly orientation has been found to be ergonomically advantageous to accommodate the normal hand position of an operator during the constant push-and-pull movement of the cleaner across the floor. If the cleaner housing and handle need to be lowered further, e.g., to positions between the two phantom line depictions in FIG. 6, the curved arcuate portion still constitutes an ergonomically correct position as a hand grip for the hand of the operator. Consequently, the operator will experience considerably less fatigue. The cross-sectional configuration of handle 16 is preferably substantially circular in the hand grip region, and can gradually converge into a more oval configuration as shown by the sectional views 16*a*–16*h*. Optionally, the topmost portion can be slightly oval in configuration with a larger vertical axis than transverse axis.

Figure 6:
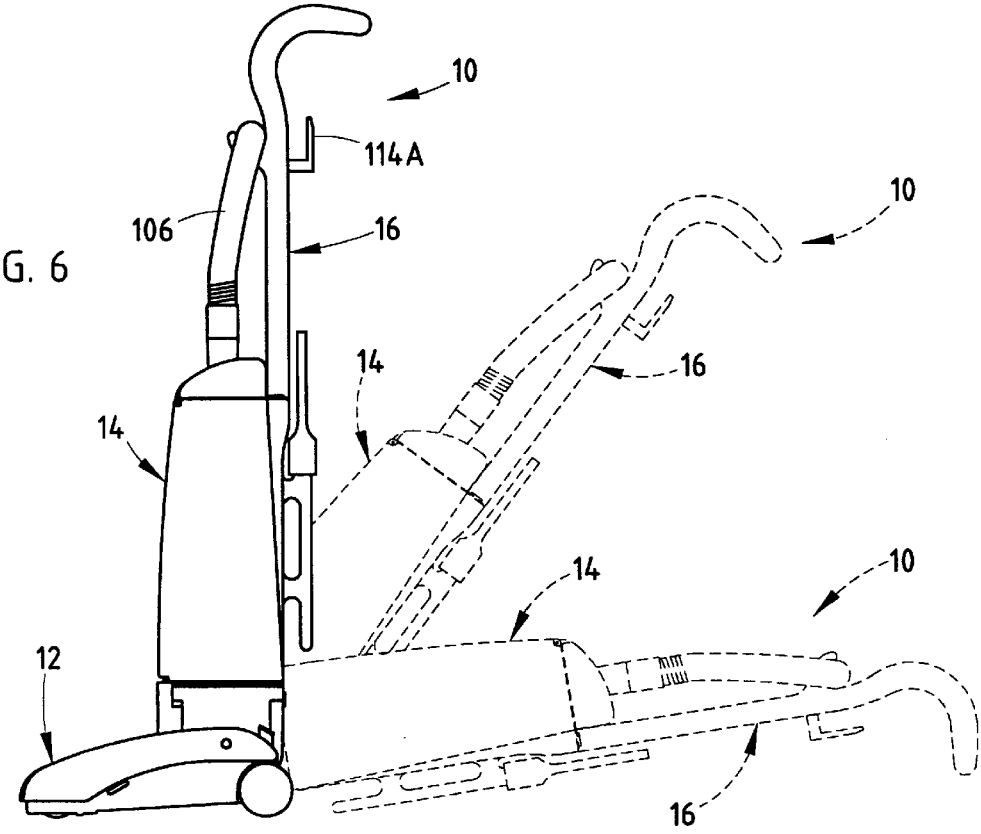
FIG. 6 is a side elevational view of the cleaner showing it in three positions.
Figure 7:
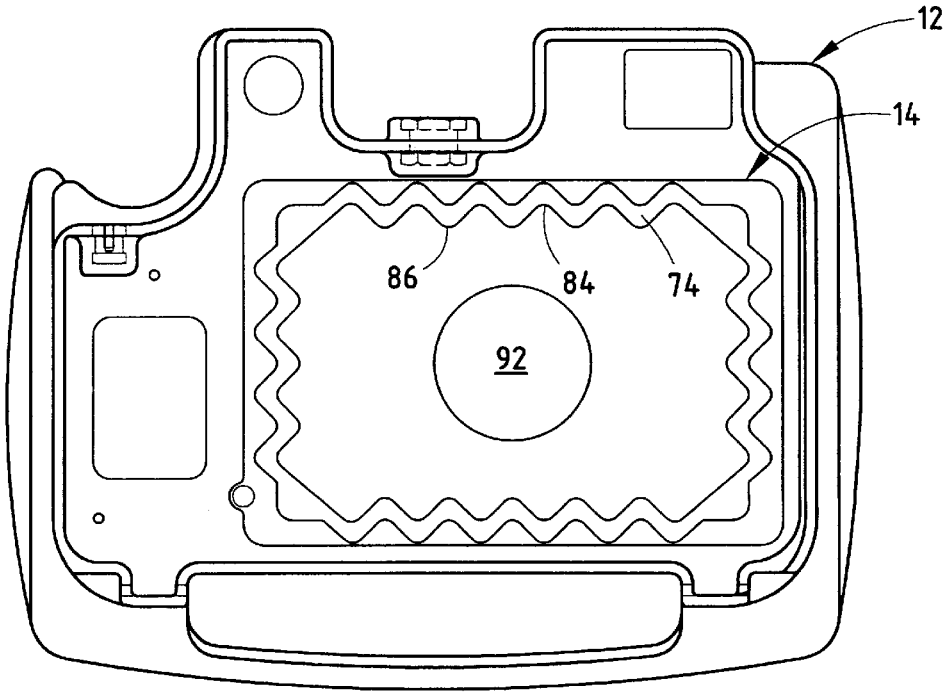
FIG. 7 is a top plan view of the bag housing.
Figure 11:
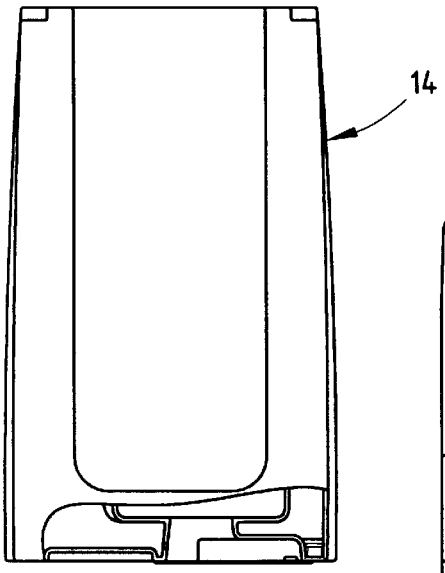
FIG. 11 is a front elevational view of the bag housing, partially sectioned.
Figure 13:
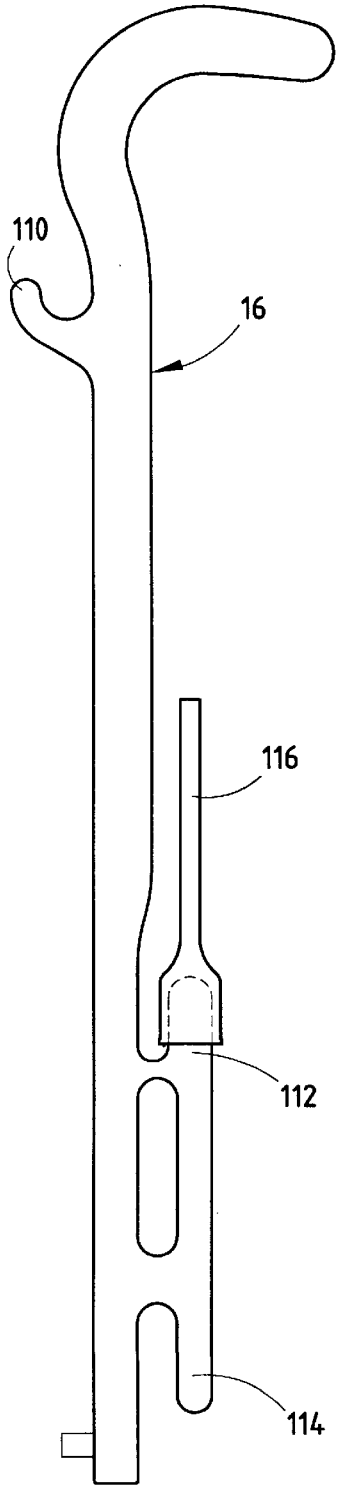
FIG. 13 is a side elevational view of the handle.
Figure 14:
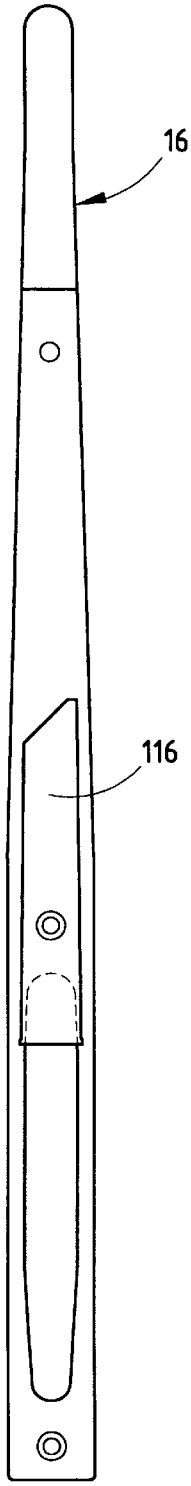
FIG. 14 is a rear elevational view of the handle.
Figure 15:
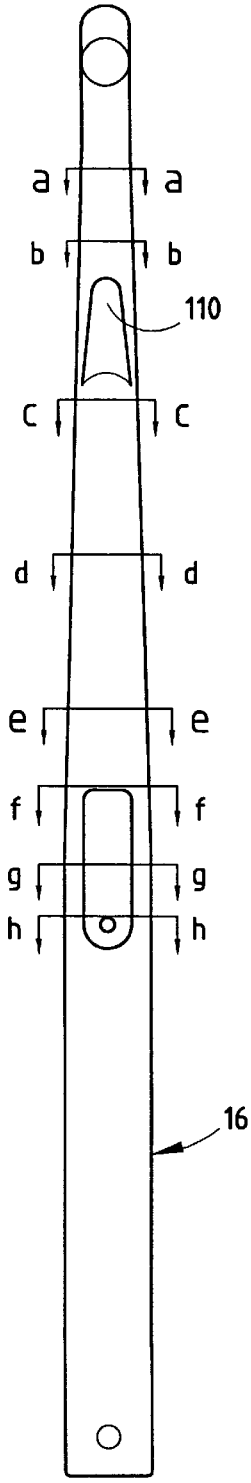
FIG. 15 is a front elevational view of the rear handle.
Figure 16A:
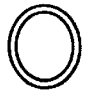
FIGS. 16A–16H are sectional views taken at various places through the handle in FIG. 15.
Figure 16B:
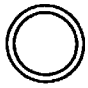
Figure 16C:
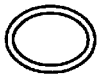
Figure 16D:
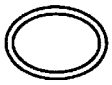
Figure 16E:
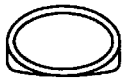
Figure 16F:
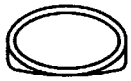
Figure 16G:
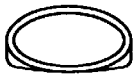
Figure 16H:
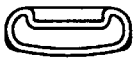

Integrally formed into the front of the upper portion of handle 16 is an upstanding hose hook 110 (FIG. 13) for draping of the vacuum hose 106 thereover as shown in FIG. 6. On the rear side of handle 16, near the upper end thereof, is an upstanding hook 114A cooperable with a lower, downwardly projecting hook 114, to serve as a cord windup zone for the electrical cord. An integral carrying handle portion 118 projecting rearwardly of handle 16 includes an upstanding hook 112 to retain a standard fitting 116. This fitting may be used for attachment to the hose to clean corner areas or the like.

During operation, a bag is placed in space 76 by pivotally opening cover 88 to provide an open top to space 76, after which the cover is pivoted closed to seal around the bag upper surface. Power is then applied to the cleaner to actuate the vacuum motor and pump unit 94, as well as electric motor 54 which drives brush 30. The operator then moves the bag housing and handle from the upright storage position to a rearward diagonal position, such as the middle position shown in FIG. 6, and pushes and pulls the cleaner back and forth across the floor surface to be cleaned. The operator's hand can slide readily from the rearmost, substantially straight portion of the handle to and from the arcuate portion, if desired. Rotating brush 30, when encountering difficult-to-retrieve particles such as sand, salt pellets, and the like, will auger the particles from both ends of brush 30 toward nozzle 38 by bouncing the particles repeatedly off inverted ledge 42, the particles advancing longitudinally along the upwardly sloped concave ledge to nozzle 38, assisted by the air flow through the concave ledge space, and hence to duct 40, from whence it moves ultimately to tube 98 into the dirt bag. Negative pressure is created in the dirt bag by the vacuum motor drawing air from the undulation recesses 84 for efficient drawing of the air through the porous bag wall which filters out the dirt. A secondary filter 120 is preferably placed over vacuum outlet 92 at the bottom of space 76 (FIG. 4). If desired, a third filter can be placed upstream of vacuum pump 94. When the dirt bag is full, as indicated by a yellow light which can be used to signal a full or a clogged bag, the unit is shut down, cover 88 is pivotally opened, and the filled dirt bag is removed, this removal being readily done because of minimal friction of the bag on the protrusions 86.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A vacuum cleaner comprising:

a housing having on its bottom side an elongated transverse brush cavity with an elongated cylindrical powered brush therein having radially extending bristles;

a duct having an opening for an air flow nozzle adjacent said brush cavity for receiving dirt-entrained air from said brush cavity;

a vacuum motor operably associated with said duct and nozzle to draw dirt-entrained air through said nozzle and duct; and said brush cavity having a pair of ends, and wrapping over said brush; said brush cavity including an elongated reflective ledge spaced sufficiently close to said brush bristles to cause debris particles to reflect off said ledge and advance to said nozzle;

wherein said nozzle is spaced from said ends of said cavity;

wherein said ledge slopes laterally upwardly from both of said ends to said opening of said nozzle.

2. The vacuum cleaner in claim 1 wherein said reflective ledge is integral with said housing.

3. The vacuum cleaner in claim 1 wherein said reflective ledge has a downwardly oriented concavity along the length of the ledge in a direction aligned with the longitudinal axis of the brush.

4. The vacuum cleaner in claim 3 wherein said reflective ledge is behind said brush, and has a surface sloping rearwardly upwardly.

5. The vacuum cleaner in claim 1 wherein said ledge is uniformly spaced from said brush over the length of said ledge.

6. The vacuum cleaner in claim 5 wherein the width of said ledge varies to remain uniformly spaced from said brush.

7. The vacuum cleaner in claim 1 wherein said brush has helically arranged bristles.

8. The vacuum cleaner in claim 7 wherein said bristles extend in opposite helical patterns from both ends of said brush toward said nozzle.

9. The vacuum cleaner in claim 1 wherein said nozzle is laterally off center from said brush.

10. The vacuum cleaner in claim 1 wherein said housing is of polymeric material.

11. A vacuum cleaner comprising:

a housing having on its bottom side an elongated transverse brush cavity with an elongated cylindrical powered brush therein having helically arranged, radially extending bristles;

a duct having an opening for an air nozzle adjacent said brush cavity for receiving dirt-entrained air from said brush cavity;

a vacuum motor operably associated with said duct and nozzle to draw dirt-entrained air through said nozzle and duct;

said brush cavity having a pair of ends, and wrapping over said brush cavity including an elongated reflective ledge spaced sufficiently close to said brush bristles to cause debris particles to reflect off said ledge and advance to said nozzle; and said ledge having an elongated concavity along the length of the cavity in a direction substantially aligned with the longitudinal axis of the brush for cooperation with said helically arranged bristles to cause air flow along said ledge concavity to said nozzle;

wherein said nozzle is spaced from said ends of said cavity; and wherein said ledge slopes laterally upwardly from both of said ends to said opening of said nozzle.

12. The vacuum cleaner in claim 11 wherein said reflective ledge is behind said brush and said brush bristles are powered upwardly toward said ledge.

13. The vacuum cleaner in claim 12 wherein said reflective ledge is integral with said housing.

14. The vacuum cleaner in claim 13 wherein said ledge is uniformly spaced from said brush over the length of said ledge.

15. The vacuum cleaner in claim 13 wherein said housing and ledge are of roto-molded polymeric material.

16. The vacuum cleaner in claim 11 wherein said bristles extend in opposite helical patterns from both ends of said brush toward said nozzle.

17. A vacuum cleaner comprising:

a housing having on its bottom side an elongated transverse brush cavity with an elongated cylindrical powered brush therein having radially extending bristles;

a duct having an air flow nozzle adjacent said brush cavity for receiving dirt-entrained air from said brush cavity;

a vacuum motor operably associated with said duct and nozzle to draw dirt-entrained air through said nozzle and duct; and said brush cavity having a pair of ends and wrapping over said brush; said brush cavity including an elongated reflective ledge spaced sufficiently close to said brush bristles to cause debris particles to reflect off said ledge and advance to said nozzle;

wherein said nozzle is spaced from said ends of said cavity; and wherein said brush has helically arranged bristles that extend in opposite helical patterns from both ends of said brush toward said nozzle.

18. A vacuum cleaner comprising:

a housing having on its bottom side an elongated transverse brush cavity with an elongated cylindrical powered brush therein having helically arranged, radially extending bristles;

a duct having an air nozzle adjacent said brush cavity for receiving dirt-entrained air from said brush cavity;

a vacuum motor operably associated with said duct and nozzle to draw dirt-entrained air through said nozzle and duct;

said brush cavity having a pair of ends and wrapping over said brush; said brush cavity including an elongated reflective ledge spaced sufficiently close to said brush bristles to cause debris particles to reflect off said ledge and advance to said nozzle; and said ledge having an elongated concavity along the length of the cavity in a direction substantially aligned with the longitudinal axis of the brush for cooperation with said helically arranged bristles to cause air flow along said ledge concavity to said nozzle;

wherein said nozzle is between said ends and said bristles extend in opposite helical patterns from both ends of said brush to said nozzle.

* * * * *

UNITED STATES PATENT AND TRADEMARK OFFICE

CERTIFICATE OF CORRECTION

PATENT NO. : 6,085,383
DATED : July 11, 2000
INVENTOR(S) : Wulff et al.

It is certified that error appears in the above-identified patent and that said Letters Patent is hereby corrected as shown below:

Column 2, line 24;
"16A-16H" should be --16a-16h--.

Column 3, lines 4 and 5;
Delete "air" before --tunnel-like--.

Column 3, line 53;
"comers" should be --corners--.

Column 6, lines 21 and 22;
After "wrapping over said brush" insert --; said brush--.

Signed and Sealed this

Second Day of January, 2001

*Attest:*

Q. TODD DICKINSON

*Attesting Officer*

*Commissioner of Patents and Trademarks*